United States Patent [19]

Hancovsky

[11] 4,279,169

[45] Jul. 21, 1981

[54] TIMER LATCH MECHANISMS

[75] Inventor: John P. Hancovsky, Greensburg, Pa.

[73] Assignee: Fonas Corporation, Latrobe, Pa.

[21] Appl. No.: 85,407

[22] Filed: Oct. 17, 1979

[51] Int. Cl.[3] ..... G05G 17/00

[52] U.S. Cl. ..... 74/3.54; 124/31

[58] Field of Search ..... 74/3.5, 3.52, 3.54, 74/3.56; 124/31, 37, 41 R; 251/74

[56] References Cited

U.S. PATENT DOCUMENTS

| | | | |
|---|---|---|---|
| 69,851 | 10/1867 | Shipman . | |
| 358,526 | 3/1887 | Woods . | |
| 513,590 | 1/1894 | Morris . | |
| 2,225,719 | 12/1940 | Shotton | 43/19 |
| 2,396,809 | 3/1946 | Addison | 251/74 X |
| 2,442,572 | 6/1948 | Sheehan | 74/3.5 |
| 2,742,734 | 4/1956 | Maras et al. | 46/74 |
| 2,888,004 | 5/1959 | Steiner | 124/27 |
| 3,232,285 | 2/1966 | Rasner | 124/21 |
| 3,572,311 | 3/1971 | Baer | 124/20 |
| 3,635,204 | 1/1972 | Plumb, Jr. | 124/16 |
| 3,802,409 | 4/1974 | Mike et al. | 124/20 R |
| 3,902,271 | 9/1975 | Turoff | 46/81 |
| 3,926,170 | 12/1975 | Dixon | 124/8 |
| 3,951,125 | 4/1976 | Dixon | 124/8 |
| 3,977,386 | 8/1976 | Meyer | 124/7 |

*Primary Examiner*—Allan D. Herrmann

*Attorney, Agent, or Firm*—Buell, Blenko, Ziesenheim & Beck

[57] ABSTRACT

A timer latch mechanism is provided having a timer mechanism which releases a gate structure by moving a linkage tied to arms so that the arms pivot intermediate their length to move pawls on one end away from the gate.

6 Claims, 4 Drawing Figures

TIMER LATCH MECHANISMS

This invention relates to a timer latch mechanism and more particularly to a latch mechanism which is released at a variable selected time interval after being energized.

Latch mechanisms which are released after a specified time interval are not per se new. Such devices in various forms have been available for many years. Unfortunately, such devices are generally complex and expensive. Such devices are also frequently very fragile and cannot be used in environments where they are likely to be subject to rough treatment. There are many situations, particularly in the toy field, where there is a need for a simple, inexpensive timer latch mechanism which will withstand rough treatment without loss of effectiveness.

I have invented a timer latch mechanism which is simple in construction and inexpensive to manufacture, which will withstand rough handling without loss of effectiveness and which is readily adapted to many types of toys using latch mechanisms.

I provide a housing, a latch chamber in said housing having an opening at one end, guide means extending centrally of said chamber toward said opening, a pair of elongate arms on opposite sides of said guide means pivoted intermediate their ends in said housing, one end of each arm extending to a point adjacent said opening in the housing, a resiliently biased pawl pivoted on said one end of each arm, said pawls normally extending transverse to said arms toward said guide means in a closed position but pivotable to an open position generally parallel to said arms, the other end of each said arm being pivotally connected to one end of a transverse link, a trip arm slidably mounted on said guide means, resilient biasing means urging said trip arm toward said opening, the other end of each said link being pivoted to said trip arm, stop means on the housing limiting the movement of said trip arm toward said opening, timer means on said housing, actuator means on said timer means to move said trip arm against the resilient biasing means and away from said stop means whereby the said other ends of said elongate arms are moved toward each other and the said pawls are moved away from each other at a preselected time on said timer, and gate means slidable on said guide means in and out of said opening, said gate means being held by said pawls in said opening and released from said pawls when the trip arm is moved by the timer actuator means, said gate means being adapted to be fixed to an element which is desired to be selectively latched and released. Preferably, the elongate arms, links and trip arm are formed integrally of a simple piece of plastic with the pivotal connections being formed in said plastic by reducing the thickness thereof. The resilient means are, in each case, preferably springs. The timer is preferably a wound spring timer having a wound spring loaded shaft carrying a transverse actuator arm at one end, a dial indicator arm at the other end and a mutilated drive gear intermediate its ends engaging a conventional timer gear train controlled by a conventional escapement so that the intermediate gear rotates at uniform speed during engagement of its teeth but is released at the mutilated portion to cause the actuator arm to accelerate prior to striking the trip arm. Preferably, a starting lever is provided in said housing engaging the escapement control arm to start and stop said timer.

In the foregoing general description of my invention I have set out certain objects, purposes and advantages. Other objects, purposes and advantages of this invention will be apparent from a consideration of the following description and the accompanying drawings in which.

Figure 1:
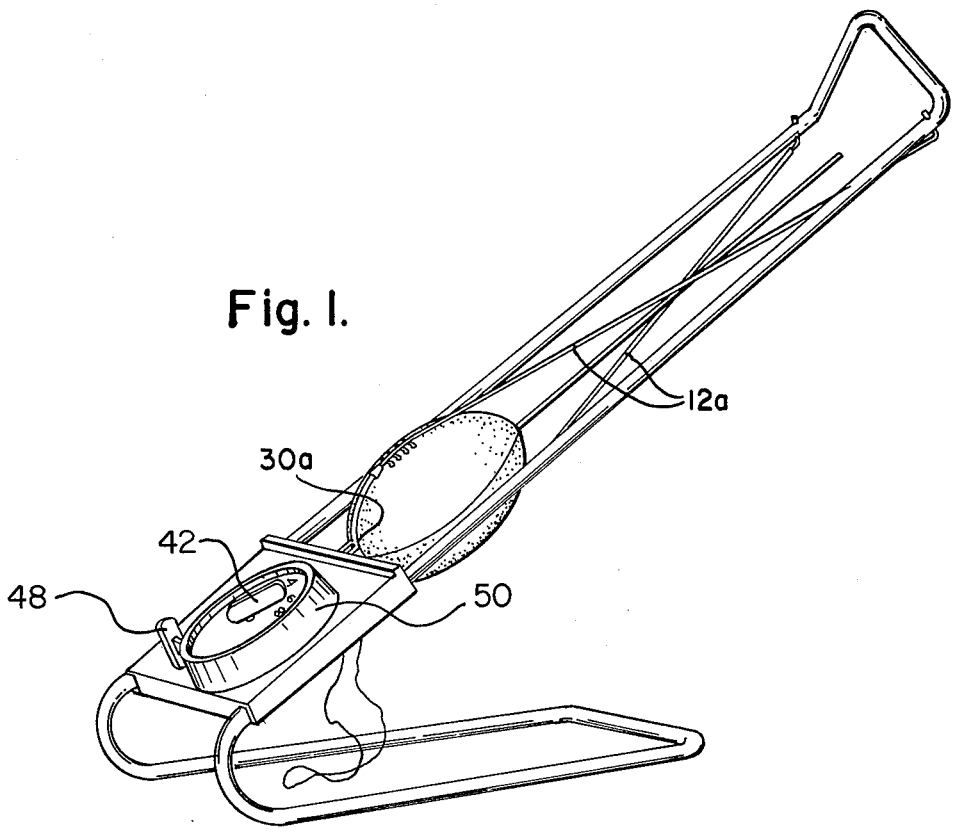
FIG. 1 is an isometric view of a timer latch mechanism of this invention used in a football passing machine as described in copending Dixon application, U.S. patent application Ser. No. 085,406 filed Oct. 17, 1979.
Figure 3:
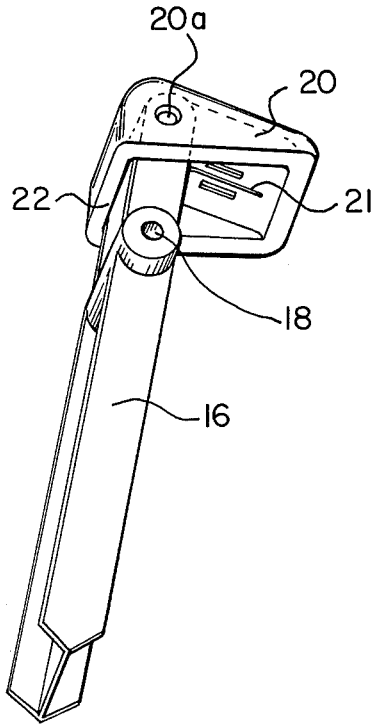
FIG. 3 is an enlarged fragmentary isometric view of the pawl.
Figure 2A:
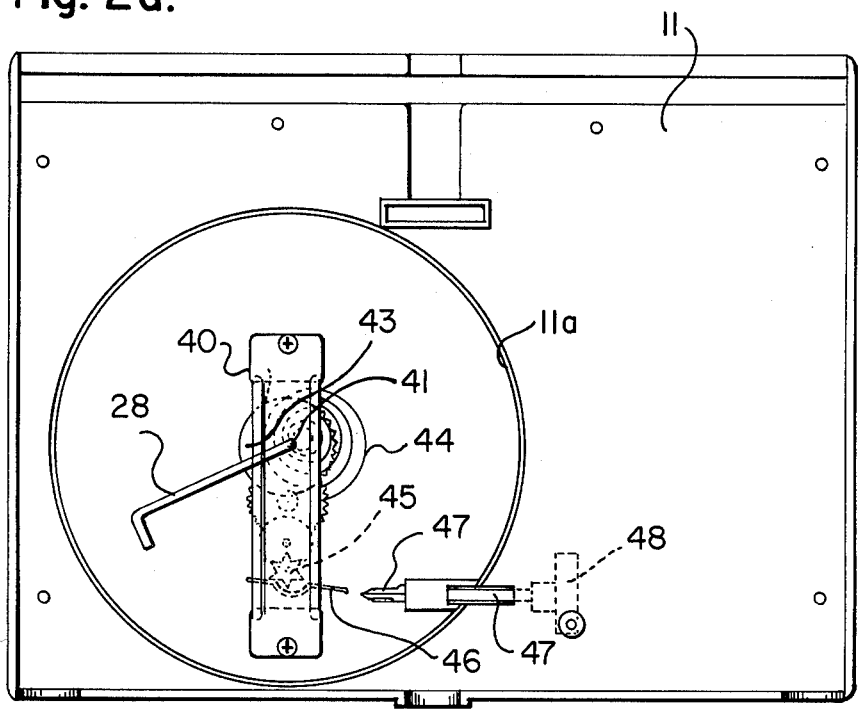
FIGS. 2A and 2B is an exploded plan view of the interior of the two halves of the housing of the timer latch apparatus of FIG. 1 showing the interior operating structure and arrangement.
Figure 2B:
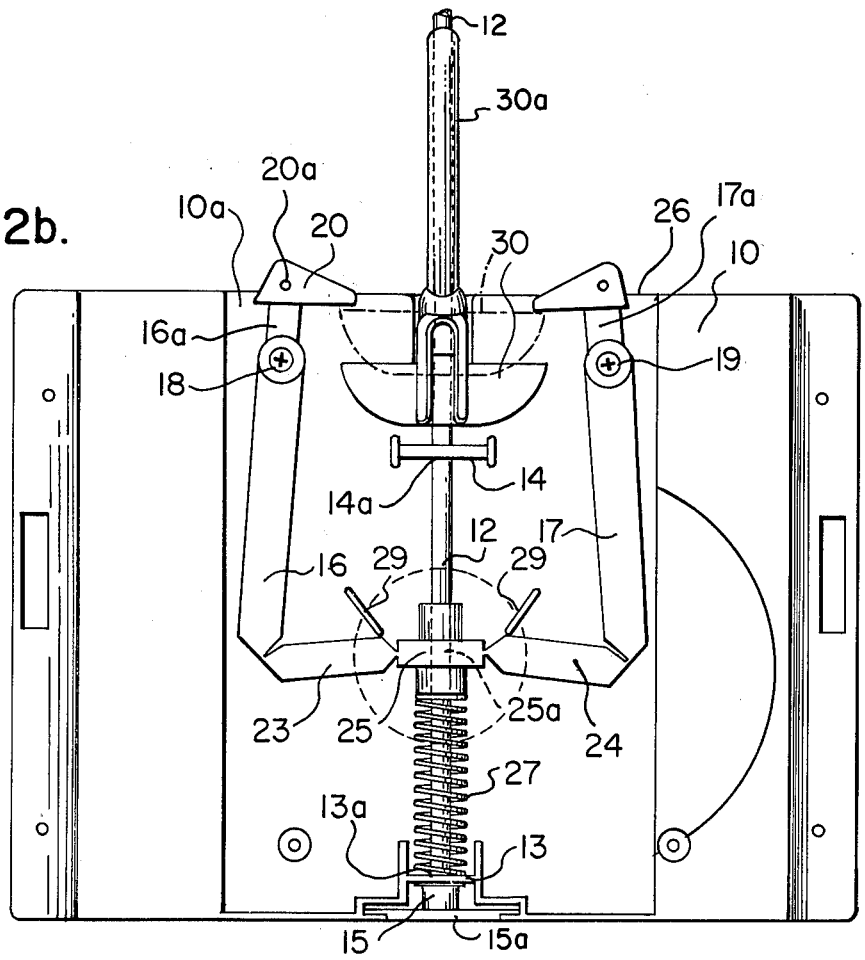

Referring to the drawings, I have illustrated a timer latch apparatus having a housing made up of two mating parts 10 and 11. Housing part 10 (FIG. 2B) carries the latch structure in a rectangular cavity 10*a* and housing part 11 carries the timer structure in a circular cavity 11*a*, each of which structures will be described in detail hereafter.

The latch structure comprises an elongate guide rod 12 extending through openings 13*a* and 14*a* in holders 13 and 14 on housing 10 and held in place by stop 15 fixed to the end of guide rod 12 and held in place by a removable sliding cover 15*a* in housing 10. Elongate arms 16 and 17 are pivoted intermediate their ends on shafts 18 and 19. One end 16*a* and 17*a* of each arm carries a pawl 20 pivoted for rotation on said end on pin 20*a* and held normally transverse to the arm by a spring 21 and stop 22. Arms 16 and 17 are preferably formed of plastic integral with links 23 and 24 and with a central trip arm 25. Trip arm 25 is provided with a passage 25*a* slidable on guide rod 12 and is urged toward opening 26 by spring 27. Trip arm 25 has a transversely extending portion which lies in the path of transverse arm 28 of the timer, which will be described later. A pair of stops 29 on housing 10 hold arms 23 and 24 and thus trip arm 25 from moving past a preselected generally horizontal position under the urging of spring 27. A gate member 30 is slidable on rod 12 and is normally held by pawls 20, as shown in chain line in FIG. 2*b*. The gate member 30 is adapted to carry a holder device 30*a* attached to biasing means 12*a* such as the football holder shown in copending Dixon application referred to above. When trip arm 25 is moved downwardly on guide rod 12 the ends of arms 16 and 17 attached to links 23 and 24 are moved inwardly toward guide rod 12 pivoting on pivot pins 18 and 19. This causes pawls 20 to be moved away from guide rod 12 and out of contact with gate 30, releasing gate 30 to permit it to move out of opening 26 on guide rod 12. When trip arm 25 returns to the normal position shown in FIG. 2B the gate 30 may be relatched by pushing it against and past pawls 20 causing them to pivot against spring 21. When gate 30 clears the ends of pawls 20, spring 21 causes them to return to normal holding or latching gate 30 against removal.

The timer mechanism carried by housing section 11 in circular cavity 11*a* comprises a frame 40 in which is journalled a transverse shaft 41 having at one end a transverse actuator arm 28 and at the other end a transverse setting handle 42. Transverse shaft 41 carries a mutilated spur gear 43 which has teeth over about 25% of its circumference and is free of teeth over the balance of the circumference. A coil spring 44 has one end fixed to shaft 41 and the other end fixed to frame 40 so that when wound tightly it imparts rotary motion to shaft 41. The frame 40 also carries conventional gearing and an escapement wheel 45 and escapement lever 46 of conventional design. A release lever 47 with an external control handle 48 is slidably mounted in housing 11 to engage and disengage escapement lever 46 so as to control operation of the timer.

In operation setting handle 42 is rotated clockwise to a desired setting 50 shown on the face of housing 11. This winds spring 44 into its contracted form and engages the teeth of gear 43 with the gears of the timer mechanism. At this point, release lever 47 is in its innermost position holding escapement lever 46 against movement. When handle 48 is moved to move release lever 47 out of engagement with escapement lever 46, spring 44 rotates shaft 41 at a rate controlled by movement of escapement lever 46 and wheel 45 so long as the gear teeth of spur gear 43 are in engagement with the gearing to escapement wheel 45. When the gear teeth on spur gear 43 runs out, shaft 41 is rapidly accelerated causing arm 28 to move rapidly and forcefully against the transverse portion of trip arm 25 causing it to move downwardly against spring 27 and to release gate 30 as described above.

In the foregoing specification I have set out certain preferred practices and embodiments of this invention; however, it will be understood that this invention may be otherwise embodied within the scope of the following claims.

I claim:

1. A timer latch mechanism comprising a housing, a latch chamber in said housing having an opening at one end, guide means extending centrally of said chamber toward said opening, a pair of elongate arms on opposite sides of said guide means pivoted intermediate their ends in said chamber, one end of each arm extending to a point adjacent said opening, a resiliently biased pawl pivoted on said one end of each arm, said pawls normally extending transversely to said arms toward said guide means in a closed latch position and pivotable to an open unlatched position generally parallel to said arms, the other end of each said arm being pivotally connected to one end of a transverse link, a trip arm slidably mounted on said guide means, resilient biasing means urging said trip arm toward said opening, the other end of each said link being pivotally connected to said trip arm, stop means on the housing limiting the movement of said trip arm toward said opening, timer means on said housing, actuator means on said timer means to move said trip arm against the resilient biasing means and away from said stop means at a preselected time whereby the said other ends of said elongate arms are moved toward each other and the pawls are moved away from each other, and gate means slidable on said guide means in and out of said opening, said gate means being held by said pawls in said opening and released from said pawls when the trip arm is moved by the timer actuator means, said gate means being adapted to be fixed to a means which is desired to be selectively latched and released.

2. A timer latch mechanism as claimed in claim 1 wherein the elongate arms, links and trip arm are formed integrally as a single piece with the pivotal connections being formed in said plastic by reducing the thickness thereof.

3. A timer latch mechanism as claimed in claims 1 or 2 wherein the resilient means is a spring.

4. A timer latch mechanism as claimed in claims 1 or 2 wherein the timer is a wound spring timer having a wound spring loaded shaft carrying a transverse actuator arm at one end, a dial indicator arm at the other end, and an escapement mechanism controlling the rate of rotation of said shaft through at least a part of its rotation.

5. A timer latch mechanism as claimed in claim 4 wherein the shaft carries a mutilated spur gear engaging a conventional gear escapement mechanism controlling the rate of rotation of said shaft through a part of its rotation by engagement with gear teeth on a part of said mutilated spur gear and releasing said shaft for accelerated rotation on reaching a non-toothed portion of said spur gear.

6. A timer latch mechanism as claimed in claim 5 wherein a starting lever is slidable in said housing in and out of engagement with an escapement lever in said escapement mechanism.

* * * * *